US008826843B2

(12) United States Patent
Moody et al.

(10) Patent No.: US 8,826,843 B2
(45) Date of Patent: Sep. 9, 2014

(54) METHODS AND APPARATUS FOR MITIGATING VORTEX RINGS AFFECTING SUBMERSIBLE VEHICLES

(71) Applicant: iRobot Corporation, Bedford, MA (US)

(72) Inventors: Ryan Moody, Durham, NC (US); Frank Agius, Cary, NC (US)

(73) Assignee: iRobot Corporation, Bedford, MA (US)

( * ) Notice: Subject to any disclaimer, the term of this patent is extended or adjusted under 35 U.S.C. 154(b) by 0 days.

(21) Appl. No.: 13/717,253

(22) Filed: Dec. 17, 2012

(65) Prior Publication Data

US 2014/0060418 A1 Mar. 6, 2014

Related U.S. Application Data

(60) Provisional application No. 61/578,692, filed on Dec. 21, 2011.

(51) Int. Cl.

| | |
|---|---|
| ***B63G 8/14*** | (2006.01) |
| ***B63G 8/08*** | (2006.01) |
| *B63G 8/00* | (2006.01) |
| *B63G 8/18* | (2006.01) |
| *B63G 8/24* | (2006.01) |
| *B63G 8/16* | (2006.01) |

(52) U.S. Cl.

CPC ..... *B63G 8/08* (2013.01); *B63G 2008/002* (2013.01); *B63G 8/14* (2013.01); *B63G 8/00* (2013.01); *B63G 8/18* (2013.01); *B63G 8/24* (2013.01); *B63G 8/16* (2013.01)

USPC ..... 114/331; 114/330

(58) Field of Classification Search

USPC ..... 114/331, 330

See application file for complete search history.

(56) References Cited

U.S. PATENT DOCUMENTS

| | | | | |
|---|---|---|---|---|
| 5,047,990 | A * | 9/1991 | Gafos et al. | 367/6 |
| 6,095,078 | A * | 8/2000 | Adams | 114/330 |
| 2010/0237165 | A1 * | 9/2010 | Krueger | 239/11 |
| 2011/0232558 | A1 * | 9/2011 | Gosling | 114/331 |

* cited by examiner

*Primary Examiner* — Lars A Olson
*Assistant Examiner* — Jovon Hayes
(74) *Attorney, Agent, or Firm* — Myers Bigel Sibley & Sajovec, PA

(57) ABSTRACT

A method for operating a submersible vehicle includes, responsive to detection of a vortex ring undesirably affecting the vehicle and/or at least one vehicle condition indicating the presence of a vortex ring undesirably affecting the vehicle, initiating at least one control action to mitigate the effect of the vortex ring on the vehicle.

13 Claims, 5 Drawing Sheets

METHODS AND APPARATUS FOR MITIGATING VORTEX RINGS AFFECTING SUBMERSIBLE VEHICLES

RELATED APPLICATION(S)

The present application claims the benefit of and priority from U.S. Provisional Patent Application No. 61/578,692, filed Dec. 21, 2011, the disclosure of which is incorporated herein by reference in its entirety.

FIELD OF THE INVENTION

The present invention relates to submersible vehicles and methods for operating the same.

BACKGROUND OF THE INVENTION

Monitoring of the oceans and other bodies of water for purposes of scientific research, national defense, or commercial development is becoming increasingly automated to reduce costs. For example, unmanned underwater vehicles (UUV) have emerged as key tools in the offshore engineering industry. Considerable investment is being made by nations around the world to develop UUVs for national or homeland defense. With the increasing requirement for persistent intelligence, surveillance and reconnaissance (ISR) operations in areas where access is denied or where ISR is otherwise desirably clandestine, UUVs will be increasingly put to use. Use of UUVs to service devices historically tended by submarines, deep submersible vehicles and divers will substantially reduce cost and risk to the operators. So, it can be seen, persistent ISR and other activities in problematic areas drive the need for means of sensing and communicating that do not require human intervention or costly engineering systems.

Certain warfare strategies require pervasive connectivity, including for intelligence preparation of a battle space. The strategy for preparation, particularly during the lead up to conflict in denied areas, may rely increasingly on UUVs that can gather and relay data to remote users.

SUMMARY OF THE INVENTION

According to embodiments of the present invention, a method for operating a submersible vehicle includes, responsive to detection of a vortex ring undesirably affecting the vehicle and/or at least one vehicle condition indicating the presence of a vortex ring undesirably affecting the vehicle, initiating at least one control action to mitigate the effect of the vortex ring on the vehicle.

In some embodiments, the vehicle has a negative buoyancy and is in a hovering mode wherein a propeller of the vehicle is driven to provide upward thrust to the vehicle to maintain the vehicle at or near a selected depth. The at least one vehicle condition can include a descent rate of the vehicle and a propeller speed of the propeller while the vehicle is in the hovering mode.

In some embodiments, the at least one control action disrupts the vortex ring.

According to embodiments of the present invention, a submersible vehicle includes a hull, a driven propeller to provide thrust to the hull, and a control system. The control system is configured to: detect a vortex ring undesirably affecting the vehicle and/or at least one vehicle condition indicating the presence of a vortex ring undesirably affecting the vehicle; and, in response to detection of a vortex ring undesirably affecting the vehicle and/or at least one vehicle condition indicating the presence of a vortex ring undesirably affecting the vehicle, to initiate at least one control action to mitigate the effect of the vortex ring on the vehicle.

According to embodiments of the present invention, a method for operating a submersible vehicle includes: placing the vehicle in a hovering mode wherein a propeller of the vehicle is driven to provide upward thrust to the vehicle to maintain the vehicle at or near a selected depth; and, while the vehicle is in the hovering mode, horizontally displacing the propeller to disrupt a vortex ring or potential vortex ring affecting the vehicle.

In some embodiments, horizontally displacing the propeller to disrupt a vortex ring or potential vortex ring affecting the vehicle includes horizontally displacing the propeller within a predetermined region.

According to embodiments of the present invention, a submersible vehicle includes a hull, a driven propeller to provide thrust to the hull, and a control system. The control system is configured to: place the vehicle in a hovering mode wherein the propeller is driven to provide upward thrust to the vehicle to maintain the vehicle at or near a selected depth; and, while the vehicle is in the hovering mode, horizontally displace the propeller to disrupt a vortex ring or potential vortex ring affecting the vehicle.

The control system may be configured to horizontally displace the propeller within a predetermined region to disrupt a vortex ring or potential vortex ring affecting the vehicle.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
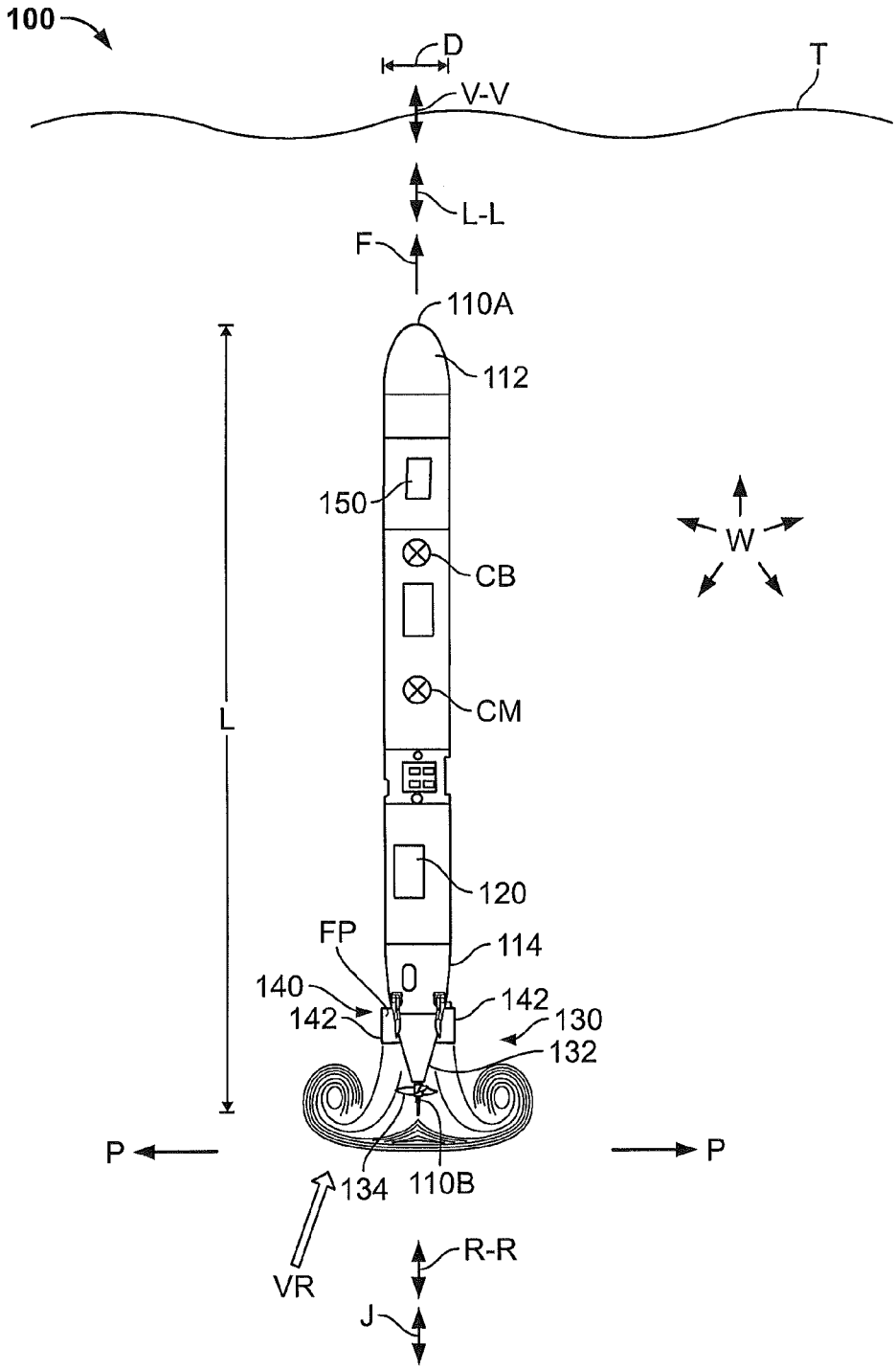
FIG. 1 is a side view of a submersible vehicle according to embodiments of the present invention hovering in a body of liquid.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the electronics device in use or operation in addition to the orientation depicted in the figures. For example, if the electronics device in the figures is turned over, elements described as "under" or "beneath" other elements or features would then be oriented "over" the other elements or features. Thus, the exemplary term "under" can encompass both an orientation of over and under. The electronics device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. Well-known functions or constructions may not be described in detail for brevity and/or clarity.

As used herein, "submersible" means an object that is submersible in an intended liquid, such as water, and constructed such that electronic and other components thereof sensitive to the liquid are protected from contact with the surrounding liquid.

"Unmanned submersible vehicle" or "unmanned underwater vehicle" (UUV) means a submersible vehicle providing self-directed mobility, communicating, and/or sensing.

The term "programmatically" refers to operations directed and/or primarily carried out electronically by computer program modules, code and instructions.

Propeller driven, finned submersible (e.g., underwater) vehicles can use a maneuver called hover to maintain a stationary position in both the horizontal and vertical planes. For this maneuver, the vehicle is oriented such that it is perpendicular to the horizontal plane of the water, with the propeller at the bottom of the vehicle providing thrust to maintain a constant depth. However, in this orientation a vortex ring, a region of rotating fluid that takes on a toroidal (doughnut) shape, may form around the propeller. This vortex ring will cause a loss of lift from the propeller thrust, which can result in the uncontrolled descent of the vehicle. Applying additional power to the propeller increases, not decreases, the descent rate as the increased power intensifies the strength of the vortex ring.

Submersible vehicles, such as unmanned submersible vehicles, according to embodiments of the present invention can overcome or address the foregoing concerns.

A hovering submersible vehicle according to some embodiments of the present invention detects when the vehicle has entered an undesired or uncontrolled descent caused by a vortex ring and, in response, initiates a control action or actions that counteract the vortex ring to stop or mitigate the undesired or uncontrolled descent. According to some embodiments, the control action frees the vehicle from the vortex ring. According to some embodiments, the control action disrupts the vortex ring.

Figure 2:
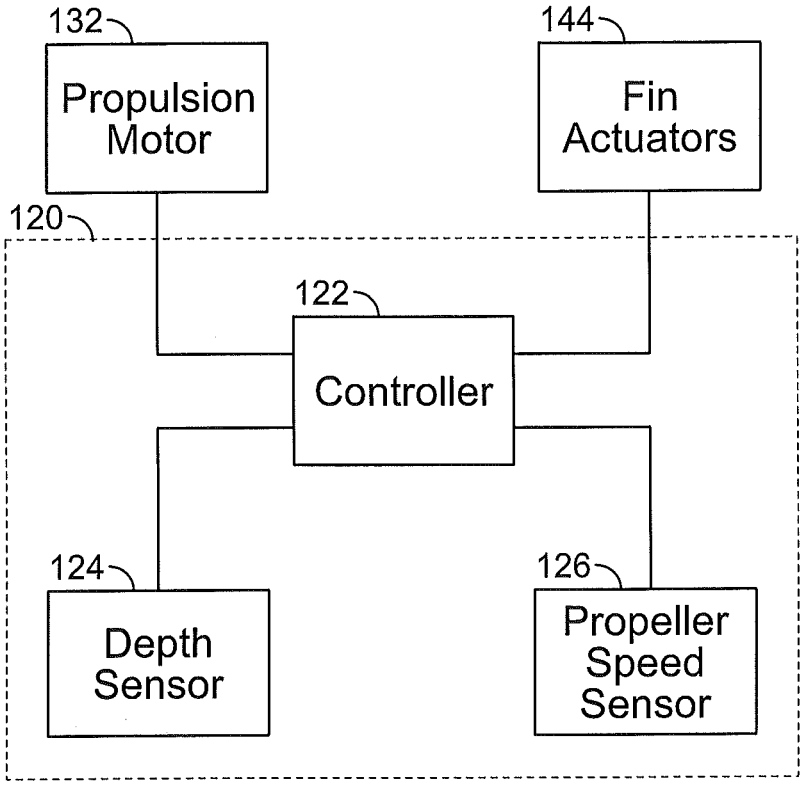
FIG. 2 is a schematic diagram of the submersible vehicle of FIG. 1 illustrating a control system thereof.

With reference to FIGS. 1 and 2, a submersible vehicle (e.g., a water submersible vehicle) 100 according to embodiments of the present invention is shown therein in a body of liquid W such as water (e.g., an ocean, river or lake) having a top surface T. In FIG. 1, vertical is indicated by the reference numeral V-V. According to some embodiments, the vehicle 100 is an unmanned submersible or underwater vehicle (UUV) or autonomous underwater vehicle (AUV). The vehicle 100 can be used for sensing, payload carrying or deploying, object servicing, and/or communicating in aquatic environments, for example.

The vehicle 100 includes a hull 110, a control system 120, a propulsion system 130, and a steering system 140. The vehicle 100 may include further components, systems or subcomponents such as a payload 150, a communications device or module, an antenna, a recharging system, and/or a power supply (e.g., a battery). The vehicle 100 has a center of buoyancy CB and a center of mass CM (FIG. 1).

The hull 110 has opposed forward and rearward ends 110A and 110B and a longitudinal axis L-L extending through the ends 110A, 110B. A forward portion or section 112 of the hull 110 is disposed at or adjacent the forward end 110A and includes a nose, which may have a streamlined, low drag profile. A rearward portion or section 114 of the hull 110 is disposed at or adjacent the rearward end 110B. According to some embodiments, the hull 110 is elongate with a length H (FIG. 1) greater than its diameter or width D. According to some embodiments, the height H is at least five times the width D.

The propulsion system 130 includes a motor 132 (FIG. 2) and a propeller 134 connected to the motor 132 to be driven thereby. The motor 132 may be an electric motor, for example. The propeller 134 rotates or spins about a propeller axis J-J coincident with or parallel to the vehicle axis L-L to provide a forward thrust to the vehicle 100. The propulsion system 130 should provide adequate thrust to drive the vehicle 100 in submerged transit and also to maintain the vehicle 100 in a hover maneuver (absent a vortex event as discussed herein).

The steering system 140 includes adjustable, driven control fins 142, and fin actuators 144 (FIG. 2) operable to rotate each fin 142 about a respective fin pivot FP. The steering system 140 can be used to selectively steer the vehicle 100 by adjusting the angle of deflection of each fin 142 relative to the vehicle axis L-L.

The vehicle control system 120 (FIG. 2) controls the operation and interoperation of the various systems. The control system 120 includes a vehicle controller 122, a depth sensor 124, and a propeller speed sensor 126. The vehicle controller 122 may include any suitable electronics (e.g., a microprocessor), software and/or firmware configured to provide the functionality described herein. While the controller 122 is illustrated herein schematically as a single module, the vehicle controller 122 may be functionally and physically distributed over multiple devices or subsystems. The depth sensor 124 may be any suitable sensor capable of detecting (directly or indirectly) a depth and/or a change in depth of the vehicle 100. In some embodiments, the depth sensor 124 generates a water depth signal representing the depth of the hull 110 in the water W. The propeller speed sensor 126 may be any suitable sensor capable of detecting (directly or indirectly) a rate of rotation (e.g., RPM) of the propeller 134. The controller 122 is operably connected to the sensors 124, 126, the motor 132 and the fin actuators 144 to receive and/or send signals from/to these components as needed to execute the operations described herein. The control system 120 may be programmed with algorithms operative to execute the operations of the hovering and correction modes described herein. Said algorithms may be embodied in computer program code configured to be executed by a suitable circuit or data processing system.

According to some embodiments, when the vehicle 100 is in an upright or hovering position as shown in FIG. 1, the center of mass CM and the center of buoyancy CB are spatially related such that the vehicle 100 will maintain a substantially vertical orientation while at rest. The vehicle 100 may otherwise move vertically while oriented in this manner.

Figure 4:
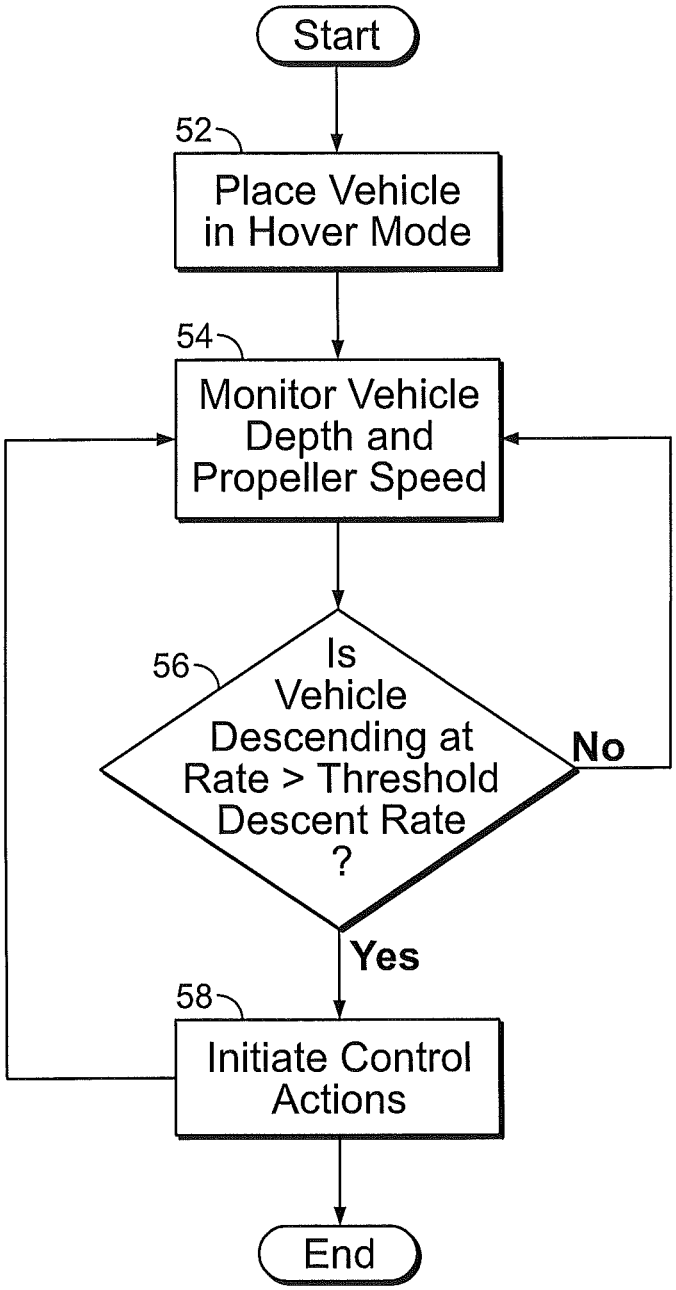
FIG. 4 is a flow chart representing operations of the submersible vehicle of FIG. 1 in accordance with methods of the present invention.

The vehicle 100 may be operated as follows in accordance with embodiments of the present invention and as schematically represented by the flow chart of FIG. 4.

Navigation or transit of the vehicle 100 can be provided by the propulsion system 130, which controllably propels the hull 110. The propulsion system 130 propels the vehicle 100 in the forward travel direction F. During transit, the controller 122 may maintain the hull 110 in a transit position wherein the longitudinal axis L-L is substantially horizontal.

On occasion, it may be desirable to place the vehicle 100 in a hovering mode or maneuver (Block 52). In the hovering mode, the control system 120 maintains the vehicle 100 in a hovering state. In the hovering state, the vehicle 100 holds at a selected depth with the hull 110 oriented in a hovering position such that the vehicle axis L-L is substantially parallel with vertical V-V. In the hovering state, the vehicle 100 may also hold a selected lateral position or, in any case, may not take action to deliberately move laterally (horizontally).

According to some embodiments, when in the hovering position, the vehicle 100 has a tail-heavy trim, meaning the vehicle 100 has a negative net buoyancy and a center of buoyancy CB forward of the center of mass CM. In this case, the vehicle 100 is maintained hovering with the forward portion 112 over the rearward portion 114 by operating the propulsion system 130 to provide a sufficient forward (i.e., upward) thrust. The vehicle 100 can be transitioned from the transit position to the hovering position by turning the hull 110 toward vertical using the steering system 140 and providing thrust from the propulsion system 130 as needed.

When in the hovering mode in the absence of a vortex ring, the amount of thrust provided by the propulsion system 130 may be controlled by the controller 122 responsive to a depth signal from the depth sensor 124. The propulsion system 130 may be operated to drive the vehicle 100 to the selected depth. The propulsion system 100 is then operated using a hover control feedback loop to provide an amount of vertical thrust to substantially equally offset the net weight (accounting for buoyancy) of the vehicle 100, as discussed below. In this way, the vehicle 100 is held at the selected depth or altitude (within a permitted range of deviation). Thus, it will be appreciated that, in the hovering mode, the propeller 134 is continuously driven, thereby generating a rearwardly directed propeller wash. As a result of reaction torque from the propeller 134, the hull 110 rotates or spins about the vehicle axis L-L in a direction opposite the rotation of the forward driving propeller 134. The fins 142 are positioned such that they do not tend to angularly displace the vehicle axis L-L with respect to the vertical axis V-V. For example, the fins 142 may be oriented to align in parallel with the vehicle axis L-L (i.e., at 0 degrees deflection) as shown in FIG. 1.

Figure 3B:
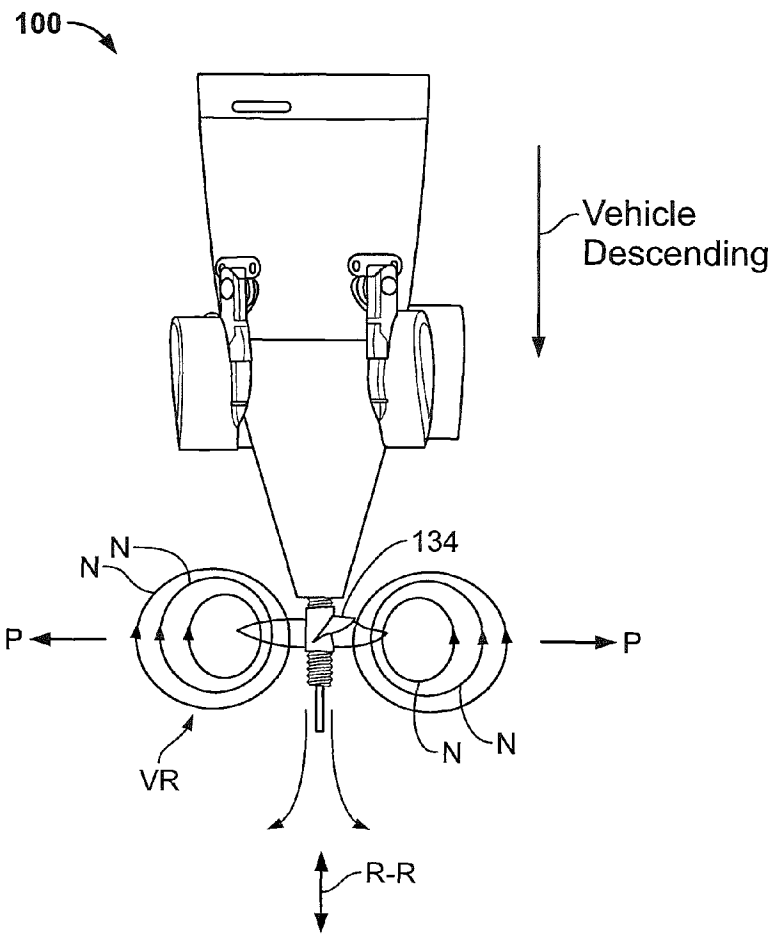
FIGS. 3A-3D illustrate operations of the submersible vehicle of FIG. 1 in accordance with methods of the present invention.
Figure 3A:
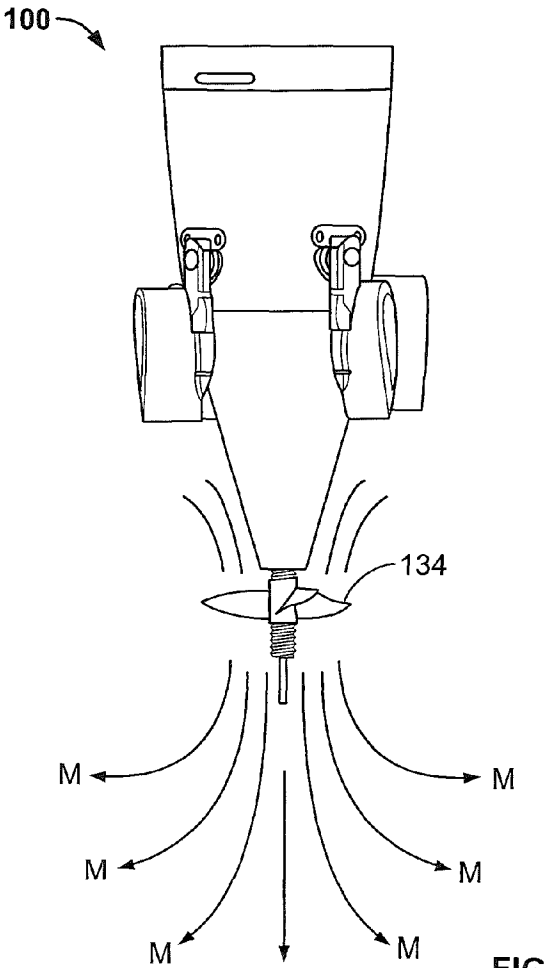

As discussed above, a vehicle hovering as described may generate a vortex ring VR that causes the vehicle to descend, in some cases uncontrollably, notwithstanding the provision of a propeller drive speed otherwise sufficient to maintain depth. With reference to FIGS. 1 and 3B, such a vortex ring VR is illustrated therein having a central axis R-R and a vortex plane P-P (defined by and within which the toroid of the vortex ring VR generally lies). Formation of the vortex ring VR is illustrated in FIGS. 3A and 3B. In FIG. 3A, notional flow lines M indicate the flow of water around the propeller 134 as the vehicle 100 is hovering (holding station) or climbing in the water column. If the vehicle 100 remains on axis (i.e., the vehicle axis L-L and the propeller axis J-J remain in alignment with vertical V-V) and begins to descend, a vortex ring VR may form around the propeller 134 quickly as shown in FIG. 3B. The vortex ring VR is characterized by a recirculation of water as illustrated by flow lines N. The water impinges on the top side of the propeller disc with an already high downward velocity thereby reducing the effective thrust of the propeller 134. To remedy this condition, it is necessary to break the vortex and expose the propeller 134 to water that does not have a high downward velocity.

While the vehicle 100 is hovering in the hovering mode, the control system 120 monitors the sensors 124, 126 and uses the signals from the sensors 124, 126 to control the propulsion system 130 and detect the presence of a vortex event (Block 54). If the depth of the vehicle 100 is too low, the control system 120 increases the speed of the propeller 134 to drive the vehicle 100 up and, if the depth of the vehicle 100 is too high, the control system 120 decreases the speed of the propeller 134 to permit the vehicle 100 to sink. According to some embodiments, the controller automatically programmatically monitors the sensors and controls the propeller speed in this manner.

If the controller 122 determines that the rate of descent of the vehicle 100 is less than a threshold descent rate, the controller 122 determines or identifies a vortex event (Block 56). In response to identification of a vortex event, the controller 122 places the vehicle in a correction mode and initiates a control action or actions that counteract the vortex ring to stop or mitigate the descent (Block 58). According to some embodiments, the controller 122 automatically programmatically identifies a vortex event, automatically programmatically initiates the control action(s), and automatically programmatically executes the control action(s).

The threshold descent rate may be determined in any suitable manner. According to some embodiments, a vortex event is identified if the vehicle is descending and the rate of descent exceeds that which is expected within normal variations based on the speed of the propeller 134. According to some embodiments, a vortex event is identified when the propeller speed is greater than a reference propeller speed known or expected to prevent descent or to maintain the descent rate at a descent rate less than the sensed descent rate, and the descent rate and/or term of descent is/are not indicative of a transient water current. According to some embodiments, the reference propeller speed is the vehicle's maximum propeller speed. According to some embodiments, a vortex event is identified when the controller 122 increases the propeller speed by at least a prescribed amount and the increase in propeller speed does not reduce the rate of descent. Other algorithms may be employed by the controller 122 to identify a vortex event.

According to some embodiments, the control action initiated by the controller 122 is adapted to disrupt the vortex ring VR. Any suitable control action that disrupts the vortex ring VR may be employed.

Figure 3D:
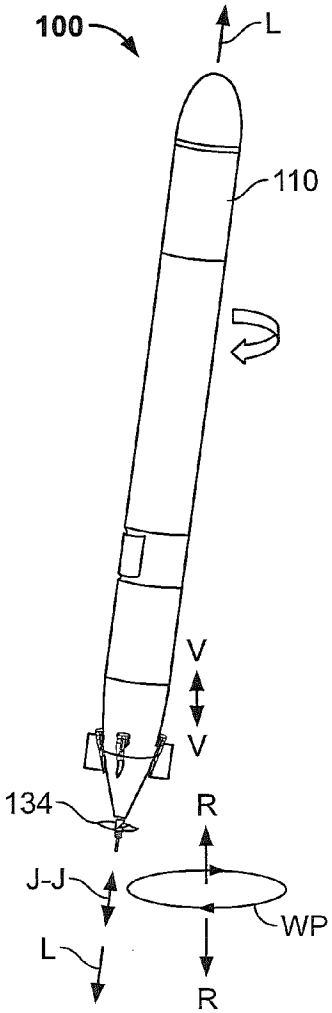
Figure 3C:
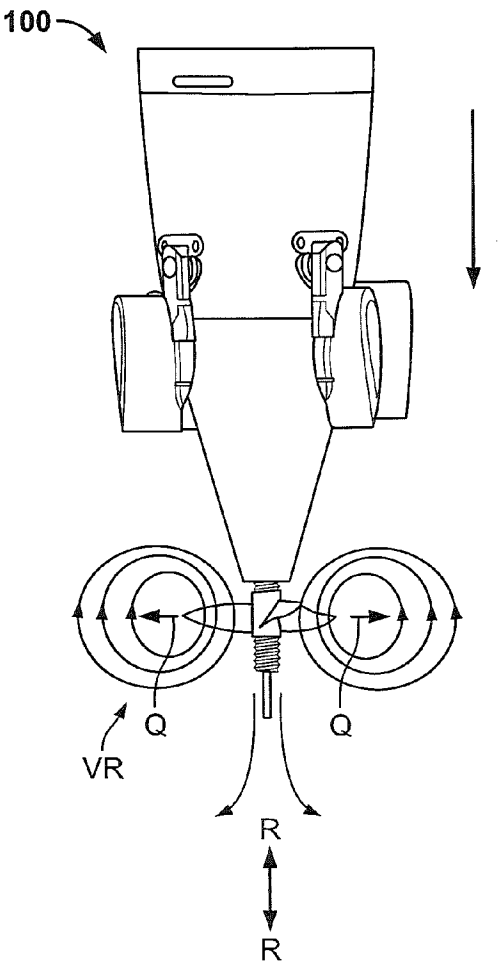

According to some embodiments, the controller 122 disrupts the vortex ring VR by translating the propeller 134 (i.e., translating the propeller rotation axis J-J) horizontally or laterally with respect to vertical V-V and the vortex ring axis R-R (e.g., in a radial direction Q as indicated in FIG. 3C) to thereby expose the propeller 134 to water that does not have a high downward velocity. According to some embodiments, the controller 122 disrupts the vortex ring VR by displacing or translating the propeller 134 horizontally in a predetermined, predefined or confined region while hovering. The controller 122 may cause the propeller 134 to translate or be displaced laterally in a limited region or area while also actuating the vehicle 100 to return to a prescribed depth or to substantially maintain the vehicle 100 at or proximate a prescribed depth in the hovering state (however, the vehicle 100 may continue for some time to descend under the influence of the vortex ring VR).

According to some embodiments, the controller 122 disrupts the vortex ring VR by inducing or causing the vehicle 100 to wobble or precess. In order to translate the propeller 134 horizontally and induce a wobble, the controller 122 may control the fin actuators 144 to rotate one or more of the fins 142 (typically, all) about their pivot axes FP so that the fins 142 are angled or deflected relative to the vehicle axis L-L. The fins 142 are oriented such that the rotation of the vehicle hull 110 about the axis L-L (the hull's axis of rotation) causes the vehicle 100 to precess about approximately the vehicle center of buoyancy CB, as illustrated in FIG. 3D. This precession causes the propeller 134 to traverse a horizontally oriented, generally circular path WP. In this manner, the lower end 110B of the hull and the propeller 134 (and the propeller axis J-J) are driven or translated horizontally radially outward relative to the vertical axis V-V, the vortex ring axis R-R, and the upper end 110A. This translation ventilates the propeller 134 with water that does not have a high downward velocity thereby enabling the propeller 134 to generate sufficient lift for the vehicle 100 to hover or ascend. The wobble disrupts the vortex ring VR, whereupon the thrust from the propeller 134 drives the vehicle 100 to ascend. The fins 142 are thereafter returned to their aligned positions to resume hovering. According to some embodiments, the fins 142 are maintained in the deflected positions until a positive rate of ascent (i.e., climb) is detected by the controller 122. According to some embodiments, the fins 142 are maintained in the deflected positions until the vehicle 100 has re-attained the desired hovering depth. The speed of the propeller 134 may be increased while the fins 142 are deflected or after the fins 142 have been returned to their non-deflected positions to cause the vehicle 100 to regain altitude.

Once the control actions have been executed and the vehicle 100 has reached the desired hovering depth, the hovering mode is resumed. The controller 122 again monitors the sensors 124, 126 to identify the presence of a vortex event and, if a vortex event is detected, will place the vehicle 100 in the correction mode. This series of events and counter-responses may occur cyclically or randomly, depending on the design of the vehicle 100, operational parameters, and environmental conditions.

Other sensors may be used in addition to or in place of the depth sensor 124 to detect changes in the depth of the vehicle 100 or the rate of change in depth of the vehicle 100. For example, an inertial sensor may be used to detect the rate of ascent and descent.

Other mechanisms may be used in addition to or in place of the fin system 140 to induce the hull into a wobble or to otherwise displace the vehicle 100 in a manner that disrupts the vortex ring VR and/or frees the vehicle from the vortex ring YR. For example, one or more auxiliary thrusters may be provided and actuated (as the control action) to force a portion of the hull laterally.

The propeller may be horizontally displaced to disrupt or prevent a vortex ring by any one or a combination of translating, displacing, precessing and wobbling as described herein. In order to prevent or disrupt the vortex ring VR, the vehicle 100 may employ other control actions or maneuvers that cause locally confined horizontal translation or lateral displacement of the propeller 134 as described herein. With provision of a suitable actuator or actuators, the vehicle may be controlled to translate the propeller 134 in a reciprocating, circular or other pattern, for example.

According to some embodiments, a vehicle as disclosed herein can hover and prevent or mitigate a vortex ring without detecting the vortex ring. For example, the vehicle 100 may be configured to periodically execute a control action as described (e.g., inducing a wobble or otherwise causing the propeller 134 to be translated horizontally or laterally with respect to the vortex ring axis R-R) so that, in the event a vortex ring VR has begun forming or has formed, it will be disrupted. By way of further example, the vehicle may be configured to execute a control action as described responsive to a deliberate or unintended descent of the vehicle that may or typically would cause a vortex ring, even if the detected parameters are not sufficient to indicate a vortex ring has formed.

The vehicle 100 may be used in a system further including a remote unit such as a satellite, a waterborne boat or vessel, a fixed platform or the like. The vehicle 100 may communicate with other components of the system (e.g., the satellite) by means of airborne communications signals. The airborne signals may additionally or alternatively include communications signals not intended for the vehicle 100 (e.g., intercepted signals) and/or signals other than communications signals sensed by the vehicle 100. The signals received by the vessel 100 may be used by the vehicle for navigation.

The vehicle 100 can be used to carry a payload 150 to a desired location. The vehicle 100 can carry one or more sensors for operations. An illustrative payload includes one or more sensors or a sensing array. In some cases, the sensor and/or array is deployable. A second illustrative payload includes a neutralization charge. A third illustrative payload is materiel for personnel. A fourth illustrative payload is a releasable device for communicating from proximate the water surface. A fifth illustrative payload includes a marker that can provide a signal, such as for navigation aiding and/or communicating.

The payload 150 may be provided as a module and may include components for vehicle guiding/navigating, sensing, communicating, operating, causing, neutralizing, marking, material-providing, and/or mass-altering, for example. In some cases, the payload 150 includes a deployable device, such as an acoustic communication node or a sonar or other sensor array. In some cases, the deployable device includes a receiver that can receive energy and/or data conducted from the vehicle 100. In some cases, the payload includes a payload battery and a payload memory for storing products of receiving, and a receiver connector, which can be of any type that can receive a submersible connector.

The payload 150 may include one or more sensors or sensing devices or modules operative to sense one or more desired parameters, conditions and/or events. According to some embodiments, the sensor payload 150 is mounted on and/or in the front portion 112. The payload may include an environmental sensor of any type that can provide desirable data, which may include a physical, chemical, biological and/or radiological sensor. Examples of physical sensors include conductivity, temperature, depth, sound/acoustic, pressure, vibration, turbulence, luminescence, turbidity, electrical and optical/light sensors. Chemical sensors can include pH, oxygen, and composition sensors, for example. Biological sensors can include bioluminescence, fluorescence, chlorophyll presence or concentration, toxicant, and species specific sensors, for example. Radiation sensors may be of any suitable type operative to detect ionizing or non-ionizing radiation.

The vehicle 100 may include a guidance module or system. The guidance system may include a guidance system as disclosed in Applicant's U.S. Published Patent Application No. US-2008-0239874-A1, published on Oct. 2, 2008, titled "Underwater Guidance Systems, Unmanned Underwater Vehicles and Methods," the disclosure of which is incorporated herein by reference.

The vehicle 100 may be used to conduct surveillance and/or survey in the operational area. In some cases, the vehicle 100 detects signals and/or images, water parameters, and/or events. In some cases, the vehicle 100 communicates responsive to detecting. In some cases, the vehicle 100 deposits and/or releases a payload. In some cases, the vehicle 100 operates or monitors a deposited or deployed payload. In some cases, the vehicle 100 recovers an object. In some cases, the vehicle 100 interchanges energy and/or data with a secondary object. One example is providing energy and/or data to a secondary object. In another example, the vehicle 100 retrieves data from a secondary object. In some embodiments, the secondary object includes a sensing system deployed in the substratum. In some embodiments, the secondary object includes another vehicle.

The vehicle may have a sensor device. The sensor device may be used to determine a location of the vehicle 100 such as by GPS or compass reading. In some cases, the sensor device detects signals and/or water parameters. In some cases, signal detection by the sensor device includes processing signals and/or parameters according to an algorithm. In some cases, the sensor device senses signals (e.g., acoustic, optical, electrical, radiation, or magnetic) indicative of a desirably sensed construction. In some cases, the sensor device infers a location of the vehicle (e.g., from signals of opportunity). The results of detecting may be processed to classify a signal and/or its source or to provide a derived parameter such as a sound velocity, a water current profile and or a water salinity profile, for example.

In some cases, a detected signal can be used to characterize, quantify, classify, identify or localize an object or signal source. In some cases, the vehicle 100 can be used to spoof, attack, jam or otherwise affect detected signals.

In some embodiments, at least a portion of the vehicle is deployed to communicate. The vehicle may send data reflective of location and/or results of processing. In some cases, the vehicle releases an expendable communication device such as disclosed in U.S. Pat. Nos. 7,496,000 and 7,496,002, the disclosures of which are incorporated herein by reference. In some cases, the released communications device uses a radio and/or an optical or acoustic transponder. In some cases, the vehicle receives signals such as commands, algorithm updates, or operational data.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A method for operating a submersible vehicle, the method comprising:

responsive to detection of a vortex ring undesirably affecting the vehicle and/or at least one vehicle condition indicating the presence of a vortex ring undesirably affecting the vehicle, initiating at least one control action to mitigate the effect of the vortex ring on the vehicle, wherein the at least one control action includes horizontally displacing the propeller to disrupt the vortex ring, horizontally displacing the propeller includes causing the vehicle to wobble or precess while in a hovering mode.

2. The method of claim 1 wherein the vehicle has a negative buoyancy and is in a hovering mode wherein a propeller of the vehicle is driven to provide upward thrust to the vehicle to maintain the vehicle at or near a selected depth.

3. The method of claim 2 wherein the at least one vehicle condition includes a descent rate of the vehicle and a propeller speed of the propeller while the vehicle is in the hovering mode.

4. The method of claim 3 wherein the at least one control action disrupts the vortex ring.

5. A submersible vehicle comprising:

a hull;

a driven propeller to provide thrust to the hull; and a control system configured to:

detect a vortex ring undesirably affecting the vehicle and/or at least one vehicle condition indicating the presence of a vortex ring undesirably affecting the vehicle; and in response to detection of a vortex ring undesirably affecting the vehicle and/or at least one vehicle condition indicating the presence of a vortex ring undesirably affecting the vehicle, to initiate at least one control action to mitigate the effect of the vortex ring on the vehicle.

6. The vehicle of claim 5 wherein the at least one control action includes horizontally displacing the propeller to disrupt the vortex ring.

7. The vehicle of claim 6 wherein horizontally displacing the propeller includes causing the vehicle to wobble or precess while in the hovering mode.

8. A method for operating a submersible vehicle, the method comprising:

placing the vehicle in a hovering mode wherein a propeller of the vehicle is driven to provide upward thrust to the vehicle to maintain the vehicle at or near a selected depth; and while the vehicle is in the hovering mode, horizontally displacing the propeller to disrupt a vortex ring or potential vortex ring affecting the vehicle.

9. The method of claim 8 wherein horizontally displacing the propeller to disrupt a vortex ring or potential vortex ring affecting the vehicle includes horizontally displacing the propeller within a predetermined region.

10. The method of claim 8 wherein horizontally displacing the propeller includes causing the vehicle to wobble or precess while in the hovering mode.

11. A submersible vehicle comprising:

a hull;

a driven propeller to provide thrust to the hull; and a control system configured to:

place the vehicle in a hovering mode wherein the propeller is driven to provide upward thrust to the vehicle to maintain the vehicle at or near a selected depth; and while the vehicle is in the hovering mode, horizontally displace the propeller to disrupt a vortex ring or potential vortex ring affecting the vehicle.

12. The vehicle of claim 11 wherein the control system is configured to horizontally displace the propeller within a predetermined region to disrupt a vortex ring or potential vortex ring affecting the vehicle.

13. The vehicle of claim 11 wherein the control system is configured to cause the vehicle to wobble or precess while in the hovering mode to disrupt the vortex ring or potential vortex ring affecting the vehicle.

* * * * *